US005282612A

United States Patent [19]

Gerlier

[11] Patent Number: 5,282,612

[45] Date of Patent: Feb. 1, 1994

[54] PLURAL COMPARTMENT CARTRIDGE FOR FLEXIBLE BILLS

[75] Inventor: André Gerlier, Sciez, France

[73] Assignee: Landis & Gyr Betriebs AG, Zug, Switzerland

[21] Appl. No.: 936,118

[22] Filed: Aug. 27, 1992

[30] Foreign Application Priority Data

Sep. 4, 1991 [CH] Switzerland ..... 02592/91

[51] Int. Cl.[5] ..... B65H 3/44

[52] U.S. Cl. ..... 271/9; 271/3.1; 271/160; 271/162; 271/273; 271/215; 271/299; 221/198; 109/53

[58] Field of Search ..... 271/3.1, 5, 9, 149, 271/160, 162, 163, 207, 279, 299, 215, 273; 221/92, 197, 198, 287, 97, 123, 124, 131; 109/53, 56, 57; 220/524, 525, 534, 544

[56] References Cited

U.S. PATENT DOCUMENTS

| | | | |
|---|---|---|---|
| 3,854,655 | 12/1974 | Armstrong . | |
| 4,168,058 | 9/1979 | Granzow et al. . | |
| 4,221,376 | 9/1980 | Handen et al. . | |
| 4,275,667 | 6/1981 | Hilton . | |
| 4,603,847 | 8/1986 | Oota et al. | 271/149 X |
| 4,731,523 | 3/1988 | Kozima . | |
| 4,889,978 | 12/1989 | Koshida et al. . | |
| 4,905,869 | 3/1990 | Grigsby et al. | 221/124 X |
| 5,092,575 | 3/1992 | Ramsey | 271/149 X |
| 5,100,022 | 3/1992 | Fukudome et al. | 271/149 X |
| 5,116,037 | 5/1992 | Gerlier et al. | 271/5 X |
| 5,139,149 | 8/1992 | Gerlier | 271/212 X |

FOREIGN PATENT DOCUMENTS

| | | | |
|---|---|---|---|
| 0069460 | 1/1983 | European Pat. Off. . | |
| 0175175 | 8/1985 | European Pat. Off. . | |
| 0177569 | 7/1989 | European Pat. Off. . | |
| 815829 | 10/1951 | Fed. Rep. of Germany | 221/97 |
| 23139 | 3/1981 | Japan | 271/9 |
| 145066 | 11/1981 | Japan | 271/149 |
| 153340 | 8/1985 | Japan | 271/9 |
| 244720 | 12/1985 | Japan | 271/149 |
| 88737 | 4/1987 | Japan | 271/9 |
| 922776 | 4/1963 | United Kingdom . | |
| 2014963 | 9/1979 | United Kingdom . | |
| 2039264 | 8/1980 | United Kingdom | 221/198 |
| 2217086 | 10/1989 | United Kingdom | 221/198 |
| 7901055 | 12/1979 | World Int. Prop. O. . | |
| 8200285 | 2/1982 | World Int. Prop. O. . | |

OTHER PUBLICATIONS

Research Disclosure, Dec. 1984, "Bannotenspeicher", p. 596.

*Primary Examiner*—H. Grant Skaggs
*Assistant Examiner*—Boris Milef
*Attorney, Agent, or Firm*—Davis Hoxie Faithfull & Hapgood

[57] ABSTRACT

A cartridge for holding flexible bills in first and second stacks, comprises a cuboid housing having first and second openings on oppositely located walls thereof, a mechanism for opening and closing the first and second openings, and pressure plates disposed within the housing which press the first and second stacks against the first and second openings, respectively. The pressure plates are parallel to each other and are movable independently of each other along a common axis. At least one of the pressure plates is movable from its associated opening to the immediate proximity of the other pressure plate, thereby making maximum use of the interior space of the cartridge.

20 Claims, 2 Drawing Sheets

PLURAL COMPARTMENT CARTRIDGE FOR FLEXIBLE BILLS

BACKGROUND OF THE INVENTION

The instant invention relates to a cartridge for receiving and dispensing flexible bills.

Such cartridges for flexible bills are suitable for the transport of banknotes between a central station and an automatic service machine and also as a reserve compartment for banknotes in the automatic service machine.

A cartridge of this type for flexible bills is known from DE-OS 23 37 398 (U.S. Pat. No. 3,854,655). A device to press upon a stack, comprising a support plate and a spring contained within the housing, holds the bills together in the stack. Space saving arrangements of the pressing device with springs are shown in DE-OS 28 51 607 (U.S. Pat. No. 4,168,058) and in DE-OS 29 07 277 (G.B. 2,014,963), and with motorized drives in EP 175,175.

Such cartridges are securely locked when they are outside the automatic service machine and can be opened only with a key by authorized persons. The cartridges are provided with a cover that can be lifted so that the stack can be replaced, and with an opening to receive and issue bills, both of which can be locked. A locking device in the form of a leaf-like band which can slide in front of the receiving and issuing opening is known from DE-OS 29 49 344 (U.S. Pat. No. 4,275,667).

The Research Disclosure No. 24820 of December 1984 shows a device to stack banknotes of given dimensions in which a ram pushes the banknote through the opening into the cartridge. Devices to stack flexible bills in different sizes and to remove them from the stack are described in the Swiss patent applications Nos. 02 556/90-1 (U.S. Pat. No. 5,139,149) and 01 031/91-8 (U.S. Pat. No. 5,116,037). The contents of the two patent applications/patents and the Research Disclosure are specifically made part of this description.

It is the object of this invention to provide a cartridge for flexible bills with room for two stacks of bills and optimal utilization of the interior space of the cartridge.

SUMMARY OF THE INVENTION

This object is achieved in accordance with the present invention which provides a cartridge for holding flexible bills in first and second stacks, comprising a cuboid housing having first and second openings on oppositely located walls thereof, a mechanism for opening and closing the first and second openings, and pressure plates disposed within the housing which press the first and second stacks against the first and second openings, respectively. The pressure plates are parallel to each other and are movable independently of each other along a common axis. At least one of the pressure plates is movable from its associated opening to the immediate proximity of the other pressure plate, thereby making maximum use of the interior space of the cartridge.

BRIEF DESCRIPTION OF THE DRAWINGS

Embodiments of the invention are explained below in greater detail by reference to the drawings in which.

DETAILED DESCRIPTION OF PREFERRED EMBODIMENTS OF THE INVENTION

Figure 1:
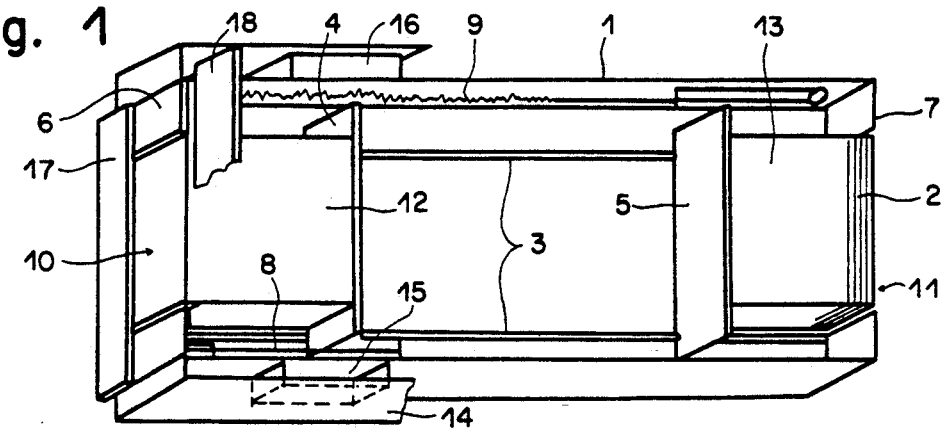
FIG. 1 shows a housing insert for the inventive cartridge with two stacks of bills.

In FIG. 1, the reference number 1 designates an essentially cuboid housing insert of a cartridge for flexible bills 2 which is equipped with two pressure plates 4, 5 mounted on rails 3, said rails 3 being placed between two sides 6, 7 facing each other in such manner that the pressure plates 4, 5 can be moved unhindered and in parallel alignment between the two sides 6, 7. The pressure plates 4 and 5 are pressed against inner surfaces of the sides 6 and 7 facing them by means of spring assemblies 8 and 9. The sides 6, 7 are provided with openings 10, 11 through which the bills 2 can be conveyed and can be deposited against the pressure plates 4 and 5. The two openings 10, 11 are at least as large as the surface of the largest bill in a predetermined set of different sizes. The bills 2 are formed as stacks 12 and 13 on the pressure plates 4 and 5.

For example, after being supplied, all the bills 2 which are banknotes in a small denomination are contained in the first stack 12 while the second stack 13 is empty. The second pressure plate 5 therefore bears against the interior wall of the second side 7. The first pressure plate 4 is displaced by the first stack 12 against the force of the first spring assembly 8 up to the second pressure plate 5 which bears upon the interior wall of the second side 7, it being possible to limit this displacement through the design of the spring assemblies 8, 9. In operation, an automatic service machine (not shown) receives banknotes in higher denominations to be changed, places them on the second stack 13 and is able to issue a predetermined number of the banknotes in the lower denomination from the first stack 12 as change. Since the number of bills being issued is always greater than the number of the bills being received, one single cartridge is sufficient for this type of operation.

Pneumatic or electro-mechanical drives to move the pressure plates 4, 5 and to produce the pressure force can also be used instead of the spring assemblies 8, 9.

Only the sum of the heights of the two stacks 12, 13 is limiting, since the movable pressure plates 4, 5 adjust themselves on the rails 3. The cartridge can therefore be filled optimally.

The housing insert 1 is contained in a housing 14 which is shown here only in part and which constitutes the outer wall of the cartridge and surrounds the housing insert 1 up to the common opening 10, 11 on all sides. The stacks 12, 13 are accessible through a cover (not shown) of housing 14 which can be locked by means of a safety lock.

At least one closing device is connected to closing plates 17 and 18 which are capable of being slid in a parallel direction and are installed in the space between the housing insert 1 and a wall of housing 14, that is, parallel to the rails 3. In one position, the openings 10, 11 are uncovered, and in the other they are securely closed.

This cartridge has the advantage that its interior space is optimally utilized by the two stacks 12, 13 because the position of the pressure plates 4, 5 adjusts to the height of said stacks 12, 13 so that the entire interior space is always available for both stacks 12, 13, and so that only a single cartridge is needed in an automatic service machine to change banknotes.

A pair of closing plates 17, 18 is located in front of the opening 10 while a similar pair of closing plates is located before the opening 11. Advantageously, the pairs of closing plates 17, 18 are coupled to each other so that they are pushed simultaneously across the openings 10, 11 by the closing means 15, 16 when the cartridge is removed from an automatic service machine. The closing plates 17, 18 are preferably pushed from opposite sides of openings 10, 11 across said openings 10, 11 until each of the closing plates 17, 18 covers one half of the openings so that together they cover them completely. In this position the closing means 15, 16 lock the closing plates 17, 18 and thus prevent the possibility of removing bills 2 when the cartridge is removed from the automatic service machine.

Figure 2:
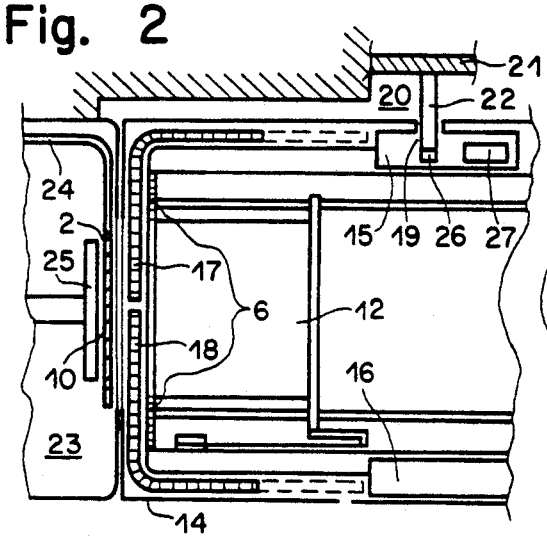
FIG. 2 shows one end of the cartridge with a closure comprising leaf-like bands in a cartridge channel in front of a bill feed system.

In FIG. 2 the housing 14 is advantageously provided with a window 19 in one of its lateral walls, said window being placed in such manner that when the cartridge is inserted into a cartridge channel 20 of the automatic service machine, a releasing device 22 mounted on a channel wall 21 of the cartridge channel 20 enters the housing 14 through window 19 and acts upon the closing means 15, 16. On each of two opposite channel walls 21 in the cartridge channel 20, a feed system 23 is installed to convey the bills 2 from a receiving and checking point of the automatic service machine to the stacks 12, 13 (FIG. 1) or to take the bills 2 from the stacks 12, 13 and convey them to an issuing point of the automatic service machine. The releasing device 22 makes it possible to align the cartridge precisely with the two feed systems 23. At the same time, the closing plates 17, 18 are unlocked and thereupon withdraw automatically from the openings 10, 11 (FIG. 1) to open them for the conveying of bills. The closing plates 17, 18 are preferably made in the form of leaf-like bands which are flexible in the direction of their movement and can easily be pulled back by the closing means 15, 16 around a 90° bend into their "open" position shown by a broken line in FIG. 2. On the other hand, the leaf-like bands are sufficiently rigid at a right angle to their direction of movement to ensure secure closing of the openings 10, 11. To ensure the covering of the bills of stacks 12, 13, it is possible for the leaf-like bands to be rolled instead of pushed over said stacks 12, 13.

Illustratively, the feed system 23 is one which is known from the initially mentioned Research Disclosure, and is installed in front of the first opening 10. A conveying path 24 guides a bill 2 over opening 10 and aligns it exactly at that location. The bill 2 is pushed through opening 10 onto stack 12 by means of a ram 25 after the closing plates 17, 18 have uncovered said opening 10. The interior wall of side 6 is provided with devices to hold down the stacks, said devices reaching into the opening 10 and being used as retention means and delimitations of the first stack 12.

The same feed system 23 can be installed in front of the second opening 11.

Advantageously, the cartridge is able to store information that can be exchanged with the automatic service machine in order to increase security of operation and protection against tampering with the cartridge. The information may include indications on the contents of stacks 12, 13 and the number of the cartridge or of the automatic service machine. A transmission device 26 installed in the cartridge channel 20 and connected to the automatic service machine is designed to read and update the contents of a storage device 27 in the cartridge. The transmission device 26 reads the information at least once after insertion of the cartridge into the cartridge channel 20 and produces a "ready" signal for the automatic service machine. A message can be transmitted to the storage device 27 after each bill movement so that when the cartridge has been removed from the automatic service machine, e.g., at a central station, the contents of the cartridge to be expected on the basis of the recorded messages can be compared to the actual contents of stacks 12, 13. The transmission device 26 can for example be installed on one end of the releasing device 22 which can be inserted into housing 14 through the window 19, while the memory 27 can be installed in the closing device 15, for instance.

Figure 3:
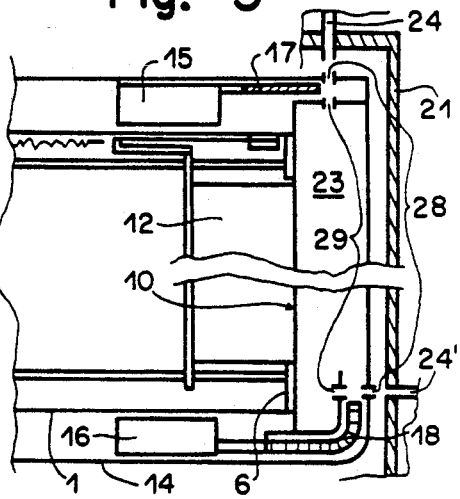
FIG. 3 shows an end of the cartridge with an integrated bill feed system.

The housing insert 1 in FIG. 3 is equipped with flange-mounted feed systems 23 on the outside of sides 6, 7 (FIG. 1) in front of the openings 10, 11 (FIG. 1) which delimit the stacks 12, 13 (FIG. 1) on sides 6, 7. In this case, the feed systems 23 are located within housing 14 and can therefore be removed from cartridge channel 20 together with housing 14. This layout has the advantage that the cartridge can be rendered especially resistant to tampering since housing 14 has only small slits 28 opening towards the outside which need to be secured, instead of the large openings 10, 11.

Each feed system 23 is provided with at least one gate 29 through which a bill is conveyed to the automatic service machine to be deposited on stack 12 for example, from which it is to be issued. Devices disclosed in U.S. Pat. Nos. 5,139,149 and 5,116,037 mentioned in the introduction could also be used as the feed systems 23.

Directly in front of each gate 29 of the feed systems 23, a slit 28 is provided at a predetermined distance from gate 29, the slit 28 and gate 29 constituting a passage 28, 29 of predetermined dimensions. The closing means 15, 16 are able to push at least one of the closing plates 17, 18 into a space contained between the slit 28 and the gate 29 and thus close off the passage 28, 29. The conveying paths 24, 24' are aligned with the passages 28, 29 and extend them outside the cartridge, leading from the slits 28 through channel wall 21 into the automatic service machine. Each opening 10, 11 or each passage 28, 29 can also be closed by means of flaps or drop doors that can be locked.

Figure 4:
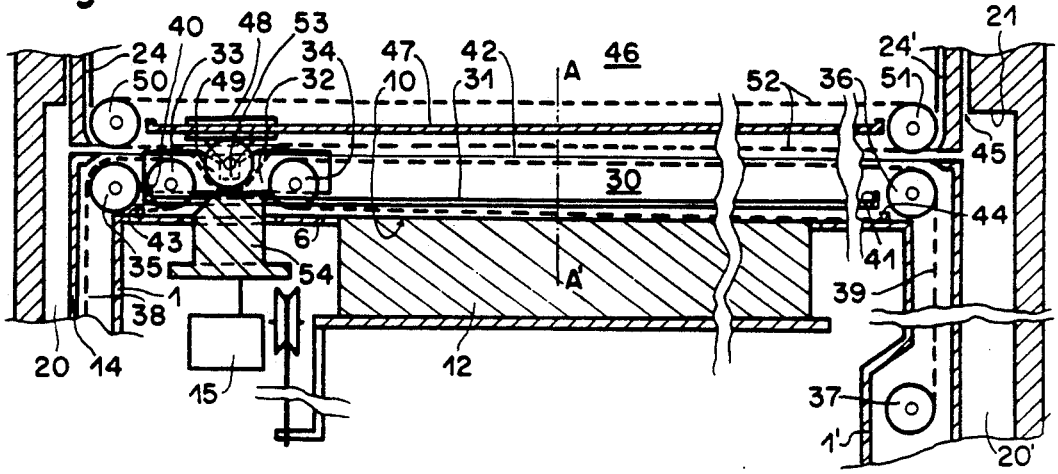
FIG. 4 shows a bill feed system comprising a covering band system at the cartridge end and a bill feed system in the cartridge channel.

The devices described in the initially mentioned U.S. Pat. Nos. 5,139,149 and 5,116,037 are advantageously designed as systems that are divisible into two parts as shown in FIG. 4. In this embodiment, one part, a covering band system 30, not only assists in conveying the bills but also makes it possible to provide a closure similar to a roller shade of housing 14 on each side 6, 7 FIG. 1).

The arrangement of the closing band system 30 is described below through an example illustrated in FIG.

4 of a side 6 of housing insert 1, 1'. The covering band system 30 comprises a carriage 32 capable of moving on sliding rails 31 over the stacks 12 and serving as a support of two outer guide rollers 33, 34, two deflection pulleys 35, 36 at the ends of the sliding rails 31, and two covering bands 38,39 capable of being wound up on band winding rollers 37. The axles of all rollers 33 to 37 are parallel to each other and at a right angle to the direction of the sliding rails 31. The sliding rails 31 are located on either side of opening 10, are parallel to its edges and guide the carriage 32 over the stack 12. The carriage 32 can be shifted on the sliding rails 31 until the guide rollers 33, 34 are outside the opening 10 in either one of the carriage's end positions 40 or 41. In FIG. 4, the carriage 32 is shown in end position 40.

The diameters of the guide rollers 33, 34 are equal and determine the distance between a covering bill plane of stack 12 coinciding with the outside of side 6 and a closure plane 42 which is parallel to it. The axles of the outer guide rollers 33, 34 are attached in a frame of carriage 32 at a predetermined distance from each other which is approximately three times the diameter of the guide rollers 33, 34. The two deflection rollers 35, 36 are installed outside the two end positions 40, 41 in housing 14, with the closure plane 42 touching the rollers 33 to 36 at a tangent.

The two covering bands 38, 39 are of a width that is predetermined by housing 14 and which is greater to a predetermined degree than the widest bill 2 (FIG. 2). The first covering band 38 is attached to the outer wall of side 6 in immediate proximity to the first deflection pulley 35, at a first fixed point 43. Covering band 38 in the covering bill plane of stack 12 is pulled forward against opening 10 to the first guide roller 33, is guided from this plane around the first guide roller 33 by 180° into the closure plane 42 and extends there as the first end band to the first deflection pulley 35 which deflects the covering band 38 into housing 14. The second covering band 39 is attached to a second fixed point 44 in immediate proximity to the second deflection roller 36, on the outer wall of side 6, and is pulled across opening 10 and beyond it to the second guide roller 34 and surrounding the latter, the second covering band 39 continues in the closure plane 42 as the second end band to the second deflection roller 36 where the second covering band 39 also disappears in housing 14. The two covering bands 38, 39 are wound and unwound under tension in housing 14 on the band winding roller 37 when the carriage 32 is moved on the sliding rail 31 across stack 12. The two end bands in the form of a roll-up closure lock the cartridge in the closing plane 42. The covering bands 38, 39 can also be put under tension by linear spring assemblies instead of band winding 37.

In the cartridge channel 20, 20', the channel walls 21 are provided with two recesses 45 facing each other in each of which a feed device 46 is installed. The feed device 46 can be moved at a vertical to the channel wall 21 against and towards the cartridge to make it possible to remove or insert the cartridge in one position, when the feed device 46 has gone back completely into the recess 45, and to constitute the entire feed system 23 (FIG. 3) together with the covering band system 30 in its other position, the operating position.

The feed device 46 is provided with a sliding path 47 parallel to the sliding rail 31 and of the same length. It supports a motor-driven, movable slide 48 with a central guide roller 49 which is located on the side towards the covering band system 30 and has an axle that is parallel to the axles of the rollers 33 to 36. The central guide roller 49 puts at least one endless band 52 guided over guide rollers 50, 51 under tension. The endless band 52 may also consist of a plurality of parallel cords.

In bringing the feed device 46 to the covering system 30, the slide 48 is automatically coupled to the carriage 32. Carriage 32 therefore does not have its own drive and can only be moved together with slide 48. The feed system 23 makes it possible to achieve slippage-free unrolling of the bill deposited as the covering bill on stack 12 or when said covering bill 2 is removed from stack 12. The processes for bill conveying are described in detail in the two patent applications/patents mentioned initially. For example, a groove 53 can be made in the frame of carriage 32, exactly between the axles of the outer guide rollers 33, 34 mounted in the frame of carriage 32. The axle of the central guide roller 49 extended on both sides is lowered into the groove 53 when the feed device 46 is presented in order to couple the slide to the carriage 32. During the presentation of the feed device 46, necessary electric or pneumatic connections can be established at the same time between the automatic service machine and the cartridge.

In its operating position, the endless band 52 lies between the two rollers 35, 50 and the first outer guide roller 33, as well as between the second outer guide roller 34 and the two rollers 36, 51 on the portion of covering bands 38, 39 designated as end band and constitute continuations of the conveying paths 24, 24'. The endless band 52 is lowered until it is at a predetermined distance from the covering-bill plane of stack 12 as a result of the central guide roller 49 being pushed between the two outer guide rollers 33, 34, whereby it is supported by the two outer guide rollers 33, 34.

A sliding closing wedge 54 is advantageously provided in at least one end position 40 or 41 of the carriage 32, it being possible for said closing wedge to be inserted between the outer guide rollers 33, 34 to block carriage 32 so that it closes the cartridge completely.

Figure 5:
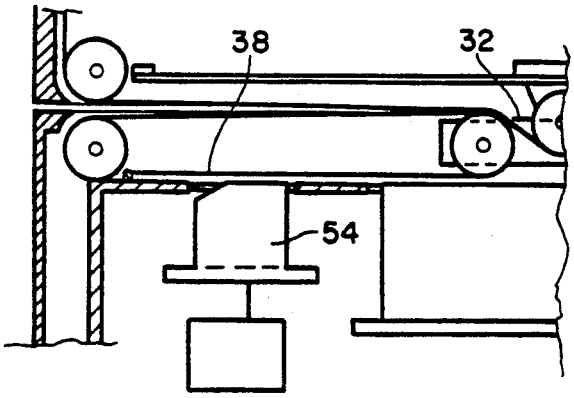
FIG. 5 shows a covering band system and the bill feed system in operation.

In the operating position, the closing wedge 54 is, for example, pressed elastically by the closing device 15 against closure plane 42. If the carriage 32 is in its end position 40 or 41, the closing wedge 54 is held down by the central guide roller 49 and the endless band 52. In another position of carriage 32, as shown in FIG. 5, the closing wedge 54 presses against one of the covering bands 38 or 39 (FIG. 4).

Figure 6:
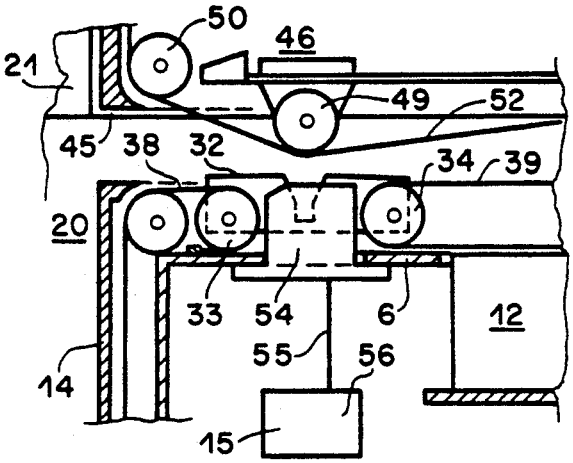
FIG. 6 shows the covering band system being blocked by a closing wedge and the bill feed device pulled back into one of the walls of the cartridge channel.

In the cartridge channel 20 of FIG. 6, the feed device 46 located on one of the two channel walls 21 is brought back completely into the recess 45. The endless band 52 is held under tension by the covering bands 38, 39 separately and directly between the two guide rollers 50, 51 (FIG. 4).

The closing wedge 54 completely fills a space delimited by the two outer guide rollers 33, 34 through which the bills 2 are conveyed in the operating position to or from stack 12. The closing device 15 is locked and prevents via rods 55 a shifting of the closing wedge 54 as long as the cartridge is outside the automatic service machine.

As soon as the cartridge is inserted completely into the cartridge channel 20 and the releasing device 22 (FIG. 2) has released the closing wedge 54 via closing device 15, the automatic service machine receives the ready-signal from the releasing device 22, indicating to said automatic service machine that at least one predetermined cartridge is present. The two feed devices 46 move towards each other until they are united with the two covering band systems 30 to constitute the two feed systems 23 (FIG. 3), whereby the central guide roller 49 presses on the released closing wedge 54 and pushes it, e.g. contrary to the action of a spring 56 in the closing device 15, into housing 14 until it is flush with the outer wall of side 6. The impediment of carriage 3 is removed and the automatic service machine can resume the prescribed operation.

Removal of the cartridge is preferably possible only in one of the two end positions 40, 41 of the carriage 32 (FIG. 4) since only one single closing wedge 54 is then required. For example, a release command can be entered for the cartridge via a control device (not shown) in the cartridge channel 20. The feed devices 46 are again retracted into the recesses 45, whereby one of the two closing wedges is pushed on either side 6, 7 (FIG. 1) between the outer guide rollers 33, 34. During this period the transmission head 26 (FIG. 3) can complete or update the contents of the memory 27 (FIG. 3). A locking device (not shown) is then released and the cartridge can be pulled out of the cartridge channel 20. As soon as the releasing device 22 detaches itself from the closing device 15, the inserted closing wedge locks into its position to close off housing 14. The cassette is advantageously provided with leaf-like bands or Pamellar plate bells as the covering bands 38, 39 which are flexible in their unwinding direction and are rigid at a right angle thereto so that the contents of the cartridge are better protected. If either side 6, 7 is provided with only one single closing wedge 54, one leaf-like band suffices to close the cartridge.

Figure 7:
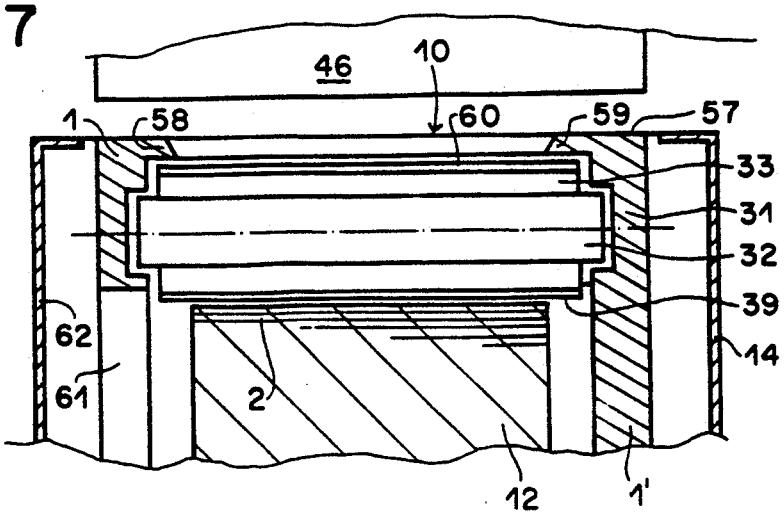
FIG. 7 shows the covering band system in cross-section.

According to FIG. 7 which shows a section in the plane A-A' of FIG. 4, the walls 57 of the housing insert 1, 1' facing the feed devices 46 project laterally in the form of projections 58, 59 beyond the parts 60 of the covering bands 38 (FIG. 4), 39 serving as end bands of the roll-up closure. Recessed angles at the two projections 58, 59 guide the parts 60 serving as end band laterally in housing insert 1, 1' and increase the stability of the roll-up closure. The distance between projections 58, 59 is at least equal to the dimension of the largest bill 2 of a given set of bills 2 accepted by the cartridge.

As shown, housing 14 can be flush with the walls 57 of the housing insert 1,1' or the walls 57 are part of housing 14 against which the housing insert 1, 1' lies in close contact within housing 14. The carriage 32 guided in the sliding rails 31 stretches the covering band 39 by means of the outer guide rollers 33, 34 (FIG. 4) over stack 12 and delimits the latter against the opening 10. A lateral wall of the housing insert 1, 1' which is parallel with the rails 3 (FIG. 1) is provided with a passage 61 which is sufficiently large for the bills 2 to be removed. The passage 61 is covered by a removable part or one made in the form of a door 62 of housing 14 and can be securely locked so that rapid loading or removal of stacked bills 2 is only possible at a central location.

Instead of the shown symmetrical design of FIGS. 1 and 2, the opening 10 or 11 (FIG. 1) can be designed so as to be locked by only one single closing plate 17 or 18.

While the invention has been described by reference to specific embodiments, this was for purposes of illustration only. Numerous alternative embodiments will be apparent to those skilled in the art and are considered to be within the scope of the invention.

I claim:

1. A bill-holding cartridge for holding flexible bills in first and second stacks, comprising a cuboid housing having first and second openings on oppositely located walls thereof, said first and second openings having retention means for retaining said bills within said housing, means for opening and closing said first and second openings, first and second parallel pressure plates disposed within said housing which press said first and second stacks of bills against said retention means of said first and second openings respectively with a pressure force, said first and second pressure plates being mounted independently on rails so that they are movable independently in parallel alignment between said walls on said rails along travel paths under action of said pressure force along a common axis, wherein the travel path of one of said first and second pressure plates on said rails is delimited by the position of the other one of said pressure plates, wherein bills introduced past said retention means into said cartridge through one of said first and second openings constitute the stack associated with said first and second openings, and wherein each of said first and second pressure plates is moved from its respective opening against said pressure force to adjust to the height of its respective stack.

2. The cartridge of claim 1 further comprising a window in said housing for receiving a releasing device of an automatic service machine for aligning said openings with respective first and second feed systems of said automatic service machine.

3. The cartridge of claim 2 further comprising closing plates coupled to said opening and closing means, and means for locking said closing plates in a closing position, and for unlocking and pushing aside said closing plates from said openings when said releasing devices is inserted into said window.

4. The cartridge of claim 3 wherein said closing plates are flexible along their direction of movement and are rigid in a direction which is transverse to said direction of movement.

5. The cartridge of claim 1 further comprising memory means in said housing for storing information relating to said first and second stacks which can be transmitted as a message by a transmission device of an automatic service machine.

6. The cartridge of claim 5 further comprising a window in said housing for receiving a releasing device of an automatic service machine for aligning said openings with respective first and second feed systems of said automatic service machine, said transmission device being installed on one end of said releasing device entering said housing through said window.

7. The cartridge of claim 1 further comprising a feed system for bills projecting into said housing on each of said sides and delimiting said stacks, said feed system including gates which align with slits in said housing, each gate aligned with a slit constituting a pair which is a passage for unhindered conveying of bills, each passage being provided with at least one closing plate which can be inserted between said gate and said slit of said pair by said opening and closing means thereby locking said cartridge.

8. The cartridge of claim 1 further comprising a covering band system along either of said walls to lock said housing, said covering band system comprising a carriage mounted on sliding rails, said carriage including two outer guide rollers which are parallel to each other and spaced apart from each other, two covering bands constituting a roll-up closure of said housing and delimiting one said stacks, and two deflection rollers, said covering bands extending in a covering bill plane of said stack from fixed points on said housing to the nearest of said guide rollers, encircle said guide roller, and extend back in a closing plane which is parallel to said covering bill plane around said deflection rollers to a band winding device located in said housing.

9. The cartridge of claim 8 wherein at least one of said covering bands is flexible in an unrolling direction and is rigid at a right angle thereto.

10. The cartridge of claim 8 further comprising a closing wedge which can be inserted by said opening and closing means between said two outer guide rolls in order to lock said carriage in an end position, said housing thereby being locked when said carriage is in said end position.

11. An arrangement comprising a cartridge according to claim 8 and an automatic service machine with said cartridge inserted in a cartridge channel of said automatic service machine, and further comprising a movable feed device provided on two cartridge channel walls facing each other of said cartridge channel, said feed device being aligned with said covering band system so that a slide of said feed device is coupled to said cartridge for joint movement therewith, wherein conveying of a bill between said covering band system and an endless band of said feed device takes place as said carriage and slide are moved together.

12. A cartridge for holding flexible bills in first and second stacks, comprising a cuboid housing having first and second openings on oppositely located walls thereof, means for opening and closing said first and second openings, first and second parallel pressure plates disposed within said housing which press said first and second stacks of bills against inner surfaces of said first and second openings respectively with a pressure force, said first and second pressure plates being movable independently of each other along a common axis, at least one of said first and second pressure plates being movable from its respective opening against said pressure force to an immediate proximity of said other pressure plate, wherein bills introduced into said cartridge through one of said first and second openings constitute the stack associated with said one opening, a window in said housing for receiving a releasing device of an automatic service machine, and means for locking said opening and closing means in a closing position, and for unlocking said opening and closing means when said releasing device is inserted into said window.

13. The cartridge of claim 12 further comprising memory means in said housing for storing information relating to said first and second stacks which can be transmitted as a message by a transmission device of said automatic service machine.

14. The cartridge of claim 12 wherein said opening and closing means include closing plates which are locked in a closing position and are unlocked and pushed aside from said openings when said releasing device is inserted into said window.

15. The cartridge of claim 14 wherein said closing plates are flexible along their direction of movement and are rigid in a direction which is transverse to said direction of movement.

16. The cartridge of claim 12 further comprising a feed system for bills projecting into said housing on each of said sides and delimiting said stacks, said feed system including gates which align with slits in said housing, each gate aligned with a slit constituting a pair which is a passage for unhindered conveying of bills, each passage being provided with at least one closing plate which can be inserted between said gate and said slit of said pair by said opening and closing means thereby locking said cartridge.

17. The cartridge of claim 12 further comprising a covering band system along either of said walls to lock said housing, said covering band system comprising a carriage mounted on sliding rails, said carriage including two outer guide rollers which are parallel to each other and spaced apart form each other, two covering bands constituting a roll-up closure of said housing and delimiting one said stacks, and two deflection rollers, said covering bands extending in a covering bill plane of said stack from fixed points on said housing to the nearest of said guide rollers, encircle said guide roller, and extend back in a closing plane which is parallel to said covering bill plane around said deflection rollers to a band winding device located in said housing.

18. The cartridge of claim 17 wherein at least one of said covering bands is flexible in an unrolling direction and is rigid at a right angle thereto.

19. The cartridge of claim 17 further comprising a closing wedge which can be inserted by said opening and closing means between said two outer guide rolls in order to lock said carriage in an end position, said housing thereby being locked when said cartridge is in said end position.

20. An arrangement comprising a cartridge according to claim 17 and an automatic service machine with said cartridge inserted in a cartridge channel of said automatic service machine, and further comprising a movable feed device provided on two cartridge channel walls facing each other of said cartridge channel, said feed device being aligned with said covering band system so that a slide of said feed device is coupled to said cartridge for joint movement therewith, wherein conveying of a bill between said covering band system and an endless band of said feed device takes place as said carriage and slide are moved together.

* * * * *